US010600559B2

(12) United States Patent
Igarashi et al.

(10) Patent No.: US 10,600,559 B2
(45) Date of Patent: Mar. 24, 2020

(54) COIL COMPONENT

(71) Applicant: MURATA MANUFACTURING CO., LTD., Kyoto-fu (JP)

(72) Inventors: Akio Igarashi, Nagaokakyo (JP); Takashi Murakami, Nagaokakyo (JP); Koji Onishi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 46 days.

(21) Appl. No.: 15/470,448

(22) Filed: Mar. 27, 2017

(65) Prior Publication Data

US 2017/0316874 A1 Nov. 2, 2017

(30) Foreign Application Priority Data

Apr. 28, 2016 (JP) ..... 2016-090525

(51) Int. Cl.

| | |
|---|---|
| ***H01F 27/29*** | (2006.01) |
| ***H01F 27/24*** | (2006.01) |
| ***H01F 27/28*** | (2006.01) |
| *H01F 17/04* | (2006.01) |
| *H01F 17/00* | (2006.01) |

(52) U.S. Cl.

CPC ..... *H01F 27/292* (2013.01); *H01F 27/24* (2013.01); *H01F 27/2823* (2013.01); *H01F 17/045* (2013.01); *H01F 27/2828* (2013.01); *H01F 2017/0093* (2013.01)

(58) Field of Classification Search

CPC ..... H01F 27/292; H01F 27/24; H01F 27/2823
USPC ..... 336/65, 83, 90, 192, 208
See application file for complete search history.

(56) References Cited

U.S. PATENT DOCUMENTS

| | | | | |
|---|---|---|---|---|
| 4,490,706 | A * | 12/1984 | Satou | H01F 5/04 336/192 |
| 5,548,264 | A * | 8/1996 | Teshima | H01F 27/027 336/192 |
| 6,249,202 | B1 * | 6/2001 | Yamada | H01F 27/29 336/192 |
| 7,471,179 | B2 | 12/2008 | Hatakeyama et al. | |
| 2004/0080391 | A1 * | 4/2004 | Fan | H01F 17/045 336/192 |

(Continued)

FOREIGN PATENT DOCUMENTS

| | | |
|---|---|---|
| CN | 103310957 A | 9/2013 |
| DE | 10 2006 024 174 A1 | 4/2007 |

(Continued)

OTHER PUBLICATIONS

An Office Action issued by the German Patent Office dated Dec. 14, 2017, which corresponds to German Patent Application No. 10 2017 207 019.6.

(Continued)

*Primary Examiner* — Tszfung J Chan
(74) *Attorney, Agent, or Firm* — Studebaker & Brackett PC

(57) ABSTRACT

A terminal electrode is secured to a flange portion with an adhesive and includes a base disposed on an outer surface of the flange portion and a mounting portion disposed above a bottom surface of the flange portion and extending from a bent portion extending from the base and covering a ridge line along which the outer surface and the bottom surface meet. The mounting portion is not secured to the flange portion.

6 Claims, 7 Drawing Sheets

(56) References Cited

U.S. PATENT DOCUMENTS

| | | | | |
|---|---|---|---|---|
| 2006/0267719 | A1* | 11/2006 | Yasuda | H01F 17/045 336/223 |
| 2007/0046413 | A1* | 3/2007 | Yamashita | H01F 17/045 336/96 |
| 2010/0109827 | A1* | 5/2010 | Asou | H01F 17/045 336/192 |
| 2017/0194085 | A1* | 7/2017 | Takagi | H01F 27/292 |

FOREIGN PATENT DOCUMENTS

| | | | | | |
|---|---|---|---|---|---|
| JP | 59144108 | A | * | 8/1984 | H01F 27/292 |
| JP | 2005-340621 | A | | 12/2005 | |
| JP | 2005340621 | A | * | 12/2005 | |
| JP | 2009-302321 | A | | 12/2009 | |
| JP | 2013191694 | A | * | 9/2013 | |
| JP | 2013191694 | A | * | 9/2013 | |
| JP | 2014099586 | A | * | 5/2014 | |
| JP | 2014216347 | A | * | 11/2014 | |
| JP | 2015-035473 | A | | 2/2015 | |

OTHER PUBLICATIONS

An Office Action mailed by the Chinese Patent Office dated Apr. 1, 2019, which corresponds to Chinese Patent Application No. 201710068797.2 and is related to U.S. Appl. No. 15/470,448 with English language translation.

* cited by examiner

COIL COMPONENT

CROSS REFERENCE TO RELATED APPLICATIONS

This application claims benefit of priority to Japanese Patent Application 2016-090525 filed Apr. 28, 2016, the entire content of which is incorporated herein by reference.

TECHNICAL FIELD

The present disclosure relates to a coil component. In particular, the present disclosure relates to a coil component that includes a drum-shaped core including a winding core portion around which a wire is wound and flange portions disposed at respective end portions of the winding core portion and that includes a terminal electrode electrically connected to an end portion of the wire and secured to one of the flange portions with an adhesive.

BACKGROUND

An interesting technique for the present disclosure is disclosed in, for example, Japanese Unexamined Patent Application Publication No. 2015-35473. A coil component 1 disclosed in Japanese Unexamined Patent Application Publication No. 2015-35473 will be described with reference to FIG. 9 and FIG. 10.

The coil component 1 includes a drum-shaped core 2, a first wire 3, and a second wire 4. The wires 3 and 4 are each made of, for example, a copper wire coated with an insulator. The drum-shaped core 2 includes a winding core portion (not illustrated because of being hidden under the wires 3 and 4) and a first flange portion 5 and a second flange portion 6 that are disposed at respective end portions of the winding core portion.

The first flange portion 5 has an inner surface 7 that faces a winding core portion and is in contact with one end portion of the winding core portion, an outer surface 9 that faces the outside and is opposite to the inner surface 7, a bottom surface 11 that connects the inner surface 7 and the outer surface 9 to each other and faces a mounting substrate during mounting, and an upper surface 13 that is opposite to the bottom surface 11.

Similarly to the first flange portion 5, the second flange portion 6 has an inner surface 8 that faces the winding core portion and is in contact with the other end portion of the winding core portion, an outer surface 10 that faces the outside and is opposite to the inner surface 8, a bottom surface 12 that connects the inner surface 8 and the outer surface 10 to each other and faces the mounting substrate during mounting, and an upper surface 14 that is opposite to the bottom surface 12.

Two terminal electrodes 15 and 17 are secured to the first flange portion 5 with an adhesive. Two terminal electrodes 16 and 18 are secured to the second flange portion 6 with an adhesive. One end portion of the first wire 3 is connected to the terminal electrode 15 disposed on the first flange portion 5, and the other end portion of the first wire 3 is connected to the terminal electrode 16 disposed on the second flange portion 6. One end portion of the second wire 4 is connected to the terminal electrode 17 disposed on the first flange portion 5, and the other end portion of the second wire 4 is connected to the terminal electrode 18 disposed on the second flange portion 6.

The terminal electrodes 15 to 18 have the same shape or are symmetric with respect to each other. The terminal electrode 15 will be representatively described in detail with reference to FIG. 10. The terminal electrode 15 includes a base 19 and a mounting portion 21. The base 19 extends along the outer surface 9 of the first flange portion 5. The mounting portion 21 extends along the bottom surface 11 of the first flange portion 5 from a first bent portion 20 that extends from the base 19 and covers a ridge line along which the outer surface 9 and bottom surface 11 of the first flange portion 5 meet. The terminal electrode 15 also includes a wire connection 23 and a wire holder 25. The wire connection 23 extends from a second bent portion 22 extending from the mounting portion 21. The wire holder 25 extends from a third bent portion 24 extending from the mounting portion 21.

Reference numbers 19, 20, 21, 22, 23, 24, and 25 that are respectively used to represent the base, first bent portion, mounting portion, second bent portion, wire connection, third bent portion, and wire holder of the terminal electrode 15 are also used to represent the base, first bent portion, mounting portion, second bent portion, wire connection, third bent portion, and wire holder of the other terminal electrodes 16 to 18.

In FIG. 10, the end portions of the wires 3 and 4 are not illustrated. The wire holders 25 are folded, and portions of the wires 3 and 4 near the end portions are nipped and held by the respective wire holders 25. The wire connections 23 are folded, and the end portions of the wires 3 and 4 are nipped by the respective wire connections 23. In this state, the end portions of the wires 3 and 4 are connected to the respective wire connections 23 by laser welding. Weld nuggets formed at the wire connections 23 are illustrated in FIG. 9.

SUMMARY

According to Japanese Unexamined Patent Application Publication No. 2015-35473, in order to secure the terminal electrodes 15 to 18 to the flange portions 5 and 6, the bases 19 are secured to the outer surfaces 9 and 10 of the flange portions 5 and 6 with an adhesive, and the mounting portions 21 are secured to the bottom surfaces 11 and 12 of the flange portions 5 and 6 with an adhesive (see paragraphs 0022, 0023, and 0029 in Japanese Unexamined Patent Application Publication No. 2015-35473).

In order to comply with market requirements, the coil component 1 needs to have sufficient mechanical durability to endure a heat cycle occurring in an actual environment after being mounted on a substrate.

In the terminal electrodes 15 to 18, not only the bases 19 are secured to the outer surfaces 9 and 10 of the flange portions 5 and 6 with an adhesive, but also the mounting portions 21 are secured to the bottom surfaces 11 and 12 of the flange portions 5 and 6 with an adhesive, as described above. Accordingly, the deformation of the terminal electrodes 15 to 18 is restricted and greatly limited by the flange portions 5 and 6 of the drum-shaped core 2, which is a rigid body.

The coil component 1 is mounted on a mounting substrate, that is, the terminal electrodes 15 to 18 are connected to conductive portions of the mounting substrate with solder interposed therebetween. In this state, when the coil component 1 is subjected to a heat cycle, stress due to the expansion or contraction of the mounting substrate caused by the heat cycle is applied to the solder. Accordingly, in some cases, a crack forms in the solder and expands. In some cases, this creates a problem in that holes are formed in electric connections between the terminal electrodes 15 to 18 and the conductive portions of the mounting substrate, or a bonding strength between the coil component 1 and the mounting substrate decreases.

In view of this, an object of the present disclosure is to provide a coil component that enables a good resistance to the heat-cycle in a mounted state.

A coil component according to one embodiment of the present disclosure includes a drum-shaped core including a winding core portion and a pair of flange portions disposed at respective end portions of the winding core portion. Each of the flange portions has an inner surface that faces a winding core portion and is in contact with the corresponding end portion of the winding core portion, an outer surface that faces an outside and is opposite to the inner surface, a bottom surface that connects the inner surface and the outer surface to each other and faces a mounting substrate during mounting, an upper surface that is opposite to the bottom surface, and a pair of side surfaces that are opposite to each other and extend in a direction so as to connect the bottom surface and the upper surface to each other.

The coil component accordingly also includes a wire wound around the winding core portion and a terminal electrode electrically connected to an end portion of the wire and secured to one of the flange portions with an adhesive. The terminal electrode includes a base disposed on an outer surface of the flange portion, and a mounting portion, for an electrical connection with a conductive portion of the mounting substrate, that is disposed above a bottom surface of the flange portion and extends from a bent portion extending from the base and covering a ridge line along which the outer surface and the bottom surface meet.

In the coil component, the mounting portion of the terminal electrode is not secured to the flange portion. With this structure, the location at which the terminal electrode is secured to the flange portion with the adhesive can be kept separate from the location at which mounting solder is applied to connect the terminal electrode to a conductive portion of the mounting substrate. Accordingly, the terminal electrode can deform with respect to the flange portion of the drum-shaped core, which is a rigid body.

It is preferable that not only the mounting portion, but also the bent portion is not secured to the flange portion. This enables the range in which the terminal electrode is deformable with respect to the flange portion of the drum-shaped core to be increased and enables the resistance to the heat cycle to be increased.

In the coil component according to the embodiment of the present disclosure, a region of the terminal electrode that is not secured to the flange portion preferably extends to a base side beyond the bent portion. With this structure, the region that is not secured to the flange portion can be widened. Accordingly, the range in which the terminal electrode is deformable with respect to the flange portion of the drum-shaped core can be further increased, and the resistance to the heat cycle can be further increased.

In the coil component according to the embodiment of the present disclosure, a groove is preferably formed on a surface of the terminal electrode that faces the outer surface of the flange portion. In this case, the adhesive is present in at least part of the groove. In the case where the groove is thus formed on the terminal electrode, the edge of the region to which the adhesive is applied is defined by the groove. This reduces the chance of the adhesive inadvertently spreading out to an undesirable area.

In the coil component according to the embodiment of the present disclosure, the adhesive preferably forms a fillet extending in a thickness direction of the terminal electrode on at least part of an edge of the base of the terminal electrode. With this structure, the fillet increases the area of contact between the terminal electrode and the adhesive. Accordingly, the formation of the fillet increases adhesive strength and ensures sufficient adhesive strength between the terminal electrode and the flange portion, even when there is no adhesive on at least the bent portion and mounting portion of the terminal electrode. In addition, the fillet suppresses misalignment of the base of the terminal electrode in the direction in which the outer surface of the flange portion extends and increases the adhesive strength of the terminal electrode in this direction.

In the coil component according to the embodiment of the present disclosure, there is a space preferably between a vicinity of the ridge line of the flange portion and a vicinity of the bent portion of the terminal electrode. The space is conducive to an increase in the degree of freedom of the deformation of the terminal electrode.

In the coil component according to the embodiment of the present disclosure, the terminal electrode can deform, which enables the terminal electrode to absorb stress due to the expansion or contraction of the mounting substrate, and stress applied to the mounting solder is reduced. Accordingly, the resistance of the coil component to the heat cycle in a mounted state can be increased.

Other features, elements, characteristics and advantages of the present disclosure will become more apparent from the following detailed description with reference to the attached drawings.

DETAILED DESCRIPTION

The coil component 31 according to the first embodiment of the present disclosure will be described with reference to FIG. 1 to FIG. 6C. More specifically, the coil component 31 illustrated forms a common mode choke coil, which is an example of coil components.

Figure 1:
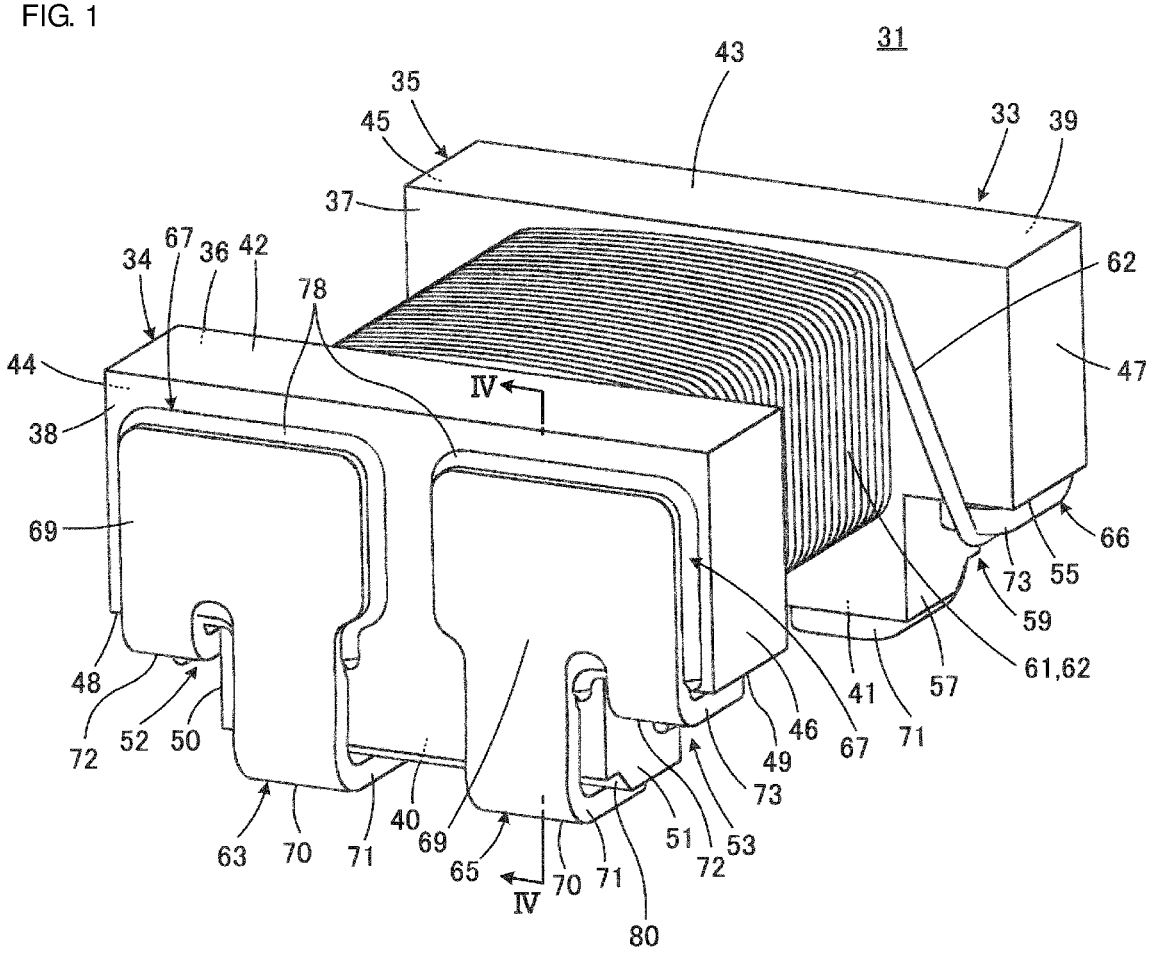
FIG. 1 is a perspective view of the appearance of a coil component according to a first embodiment of the present disclosure.
Figure 2:
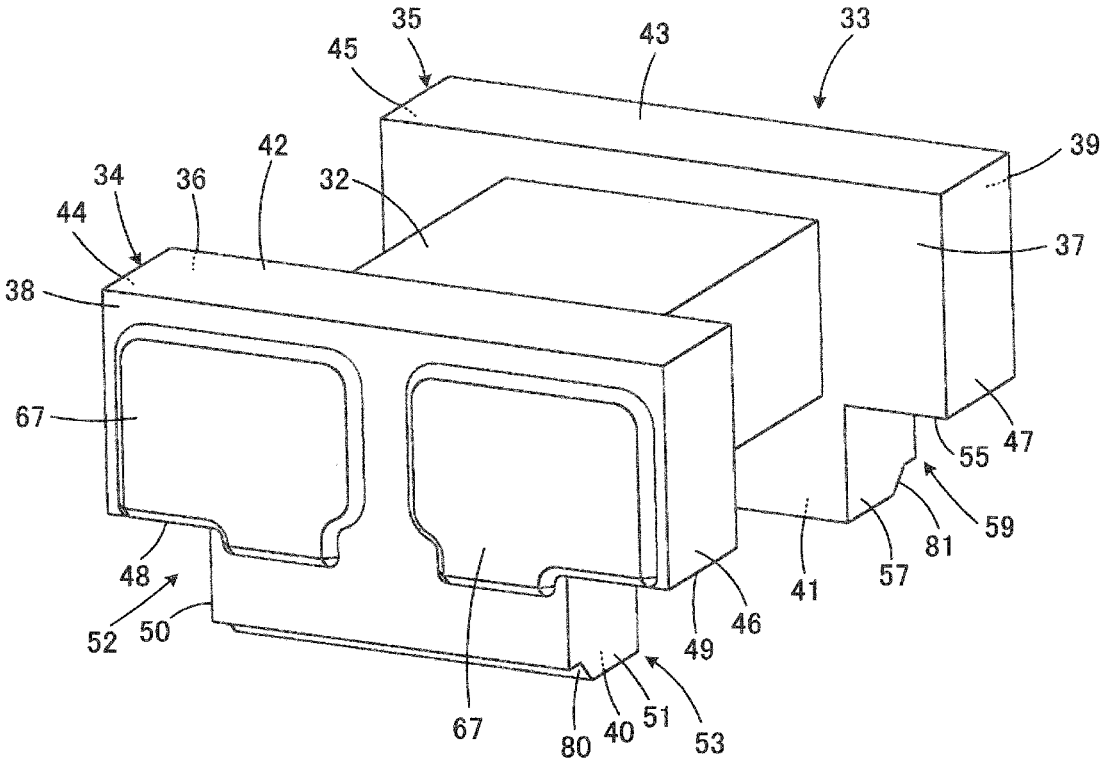
FIG. 2 is a perspective view of a drum-shaped core that the coil component illustrated in FIG. 1 includes.

As illustrated in FIG. 1 and FIG. 2, the coil component 31 includes the drum-shaped core 33 including a winding core portion 32. The drum-shaped core 33 also includes the first flange portion 34 and a second flange portion 35 that are disposed at respective end portions of the winding core portion 32. The drum-shaped core 33 is composed of, for example, a magnetic material such as ferrite. As illustrated in FIG. 2, the winding core portion 32 has, for example, a quadrangular prism shape or may have a cylindrical shape or another prism shape.

The first flange portion 34 has an inner surface 36 that faces the winding core portion 32 and is in contact with one end portion of the winding core portion 32, an outer surface 38 that faces the outside and is opposite to the inner surface 36, a bottom surface 40 that faces the mounting substrate 74 (see FIG. 5) during mounting, an upper surface 42 that is opposite to the bottom surface 40, a first side surface 44, and a second side surface 46 that is opposite to the first side surface 44. The second flange portion 35 has an inner surface 37 that faces the winding core portion 32 and is in contact with the other end portion of the winding core portion 32, an outer surface 39 that faces the outside and is opposite to the inner surface 37, a bottom surface 41 that faces the mounting substrate 74 (see FIG. 5) during mounting, an upper surface 43 that is opposite to the bottom surface 41, a first side surface 45, and a second side surface 47 that is opposite to the first side surface 45.

In the first flange portion 34, the bottom surface 40, the upper surface 42, the first side surface 44, and the second side surface 46 connect the inner surface 36 and the outer surface 38 to each other. The first side surface 44 and the second side surface 46 extend in a direction so as to connect the bottom surface 40 and the upper surface 42 to each other.

Similarly, in the second flange portion 35, the bottom surface 41, the upper surface 43, the first side surface 45, and the second side surface 47 connect the inner surface 37 and the outer surface 39 to each other. The first side surface 45 and the second side surface 47 extend in a direction so as to connect the bottom surface 41 and the upper surface 43 to each other.

In the first flange portion 34, recesses 52 and 53 in a notch shape are respectively formed at the end portions of the first and second side surfaces 44 and 46 on the side of the bottom surface 40, and the recesses 52 and 53 are defined by lateral surfaces 48 and 49 extending parallel to the bottom surface 40 and longitudinal surfaces 50 and 51 extending parallel to the side surfaces 44 and 46. The bottom surface 40 and the lateral surfaces 48 and 49 are not necessarily parallel to each other, and the side surfaces 44 and 46 and the longitudinal surfaces 50 and 51 are not necessarily parallel to each other.

Similarly, in the second flange portion 35, recesses 58 and 59 in a notch shape are respectively formed at the end portions of the first and second side surfaces 45 and 47 on the side of the bottom surface 41, and the recesses 58 and 59 are defined by lateral surfaces 54 and 55 extending parallel to the bottom surface 41 and longitudinal surfaces 56 and 57 extending parallel to the side surfaces 45 and 47. The bottom surface 41 and the lateral surfaces 54 and 55 are not necessarily parallel to each other, and the side surfaces 45 and 47 and the longitudinal surfaces 56 and 57 are not necessarily parallel to each other.

Figure 5:
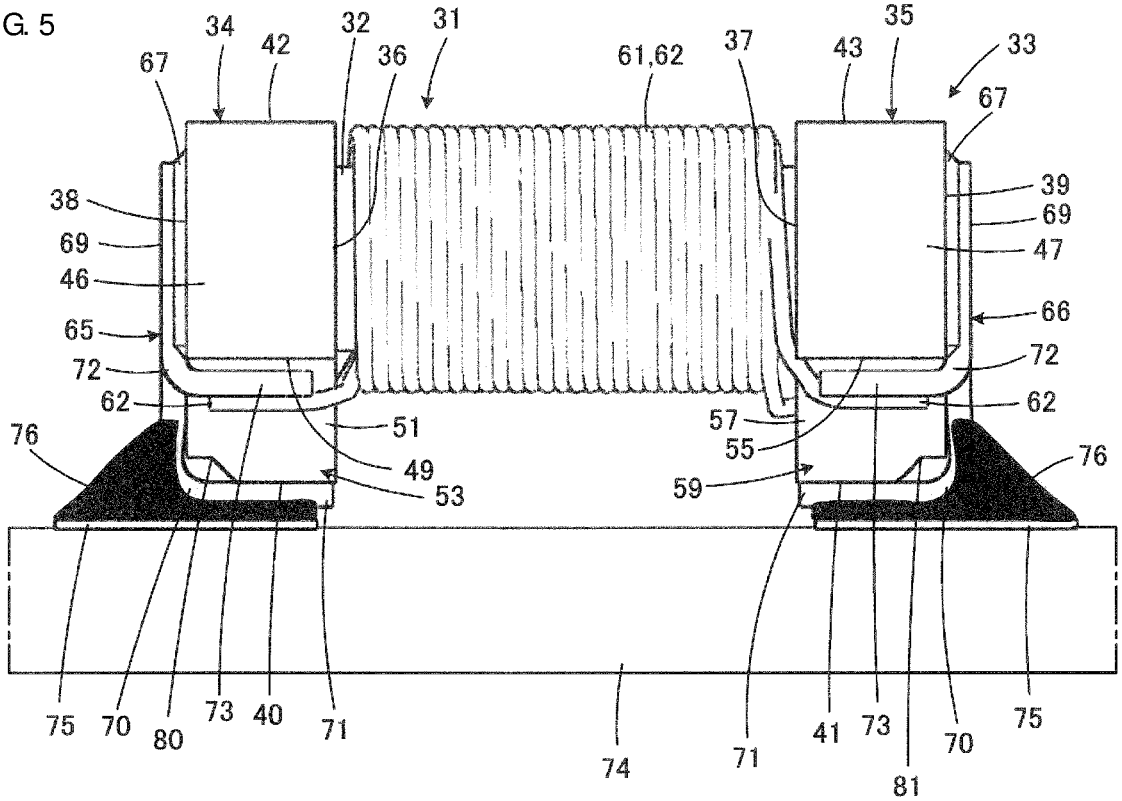
FIG. 5 is a front view of the coil component illustrated in FIG. 1 illustrating a state where the coil component is mounted on a mounting substrate.

In FIG. 1, FIG. 2, and FIG. 5, the recess 58 formed on the second flange portion 35 and the lateral surface 54 and the longitudinal surface 56 that define the recess 58 are hidden by, for example, the first flange portion 34, the second flange portion 35, or the winding core portion 32 and are not illustrated. In the following description, however, the recess and the lateral and longitudinal surfaces that are not illustrated are represented by the reference numbers "58", "54", and "56" for convenience.

The coil component 31 also includes a first wire 61 and a second wire 62 that are wound around the winding core portion 32. The wires 61 and 62 are each made of a copper wire coated with a resin insulator such as polyurethane, polyester imide, or polyamide imide.

In the case where the coil component 31 is a common mode choke coil, the wires 61 and 62 are wound in the same direction. At this time, the wires 61 and 62 may be wound so as to form two layers, that is, in a manner in which one of the wires is wound on an inner layer side, and the other wire is wound on an outer layer side, or the wires 61 and 62 may be wound in a bifilar winding manner, that is, in a manner in which the wires are arranged so as to alternate in the axial direction of the winding core portion 32 and wound so as to be parallel to each other.

The coil component 31 also includes first to fourth terminal electrodes 63 to 66. As illustrated in FIG. 1, the first and third terminal electrodes 63 and 65 of the first to fourth terminal electrodes 63 to 66 are secured to the first flange portion 34 with adhesives 67. The second and fourth terminal electrodes 64 and 66 are secured to the second flange portion 35 with the adhesives 67. In FIG. 1, part of the fourth terminal electrode 66 is illustrated, but the second terminal electrode 64 is hidden by, for example, the drum-shaped core 33 and is not illustrated. In the following description, the second terminal electrode that is not illustrated is represented by the reference number "64" for convenience.

The first terminal electrode 63 and the fourth terminal electrode 66 have the same shape, and the second terminal electrode 64 and the third terminal electrode 65 have the same shape. The first terminal electrode 63 and the third terminal electrode 65 are symmetric with respect to a plane, and the second terminal electrode 64 and the fourth terminal electrode 66 are symmetric with respect to a plane. Accordingly, one of the terminal electrodes of the first to fourth terminal electrodes 63 to 66, for example, the third terminal electrode 65 will be described in detail, and the detailed description of the first, second, and fourth terminal electrodes 63, 64, and 66 is omitted.

Figure 3:
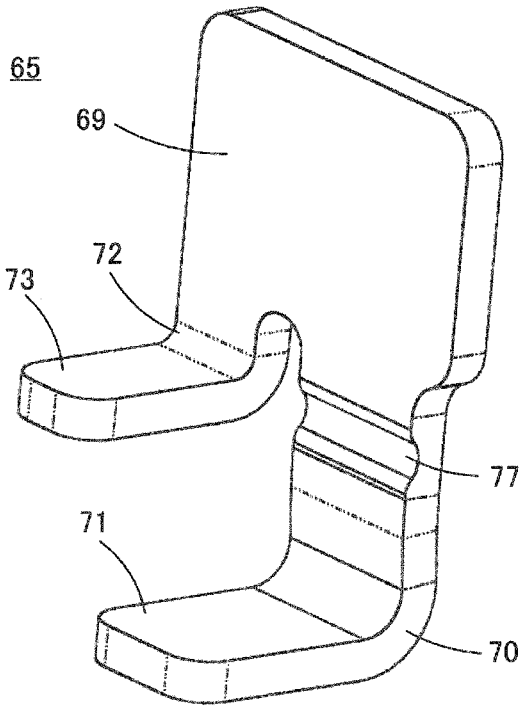
FIG. 3 is a perspective view of a terminal electrode illustrated as a separated item that the coil component illustrated in FIG. 1 includes.

The third terminal electrode 65 is illustrated alone in FIG. 3. The third terminal electrode 65 is typically manufactured in a manner in which a metallic plate made of, for example, a copper alloy such as phosphor bronze or tough pitch copper is subjected to sheet metal working but may be manufactured by using another manufacturing method such as casting.

The third terminal electrode 65 includes a base 69 extending along the outer surface 38 of the first flange portion 34 and a mounting portion 71 extending along the bottom surface 40 of the first flange portion 34 from a first bent portion 70 extending from the base 69 and covering the ridge line along which the outer surface 38 and bottom surface 40 of the first flange portion 34 meet. That is, the base 69 is disposed on the outer surface 38 of the first flange portion 34, and the mounting portion 71 is disposed above the bottom surface 40 of the first flange portion 34 and extends from the first bent portion 70.

The third terminal electrode 65 also includes a wire connection 73 extending from a second bent portion 72 extending from the base 69. The wire connection 73 is disposed in the recess 53 formed on the first flange portion 34.

The reference numbers 69, 70, 71, 72, and 73, which are respectively used to represent the base, first bent portion, mounting portion, second bent portion, and wire connection of the third terminal electrode 65, are also used to represent the base, first bent portion, mounting portion, second bent portion, and wire connection of the other terminal electrodes 63, 64, and 66.

One end portion of the first wire 61 is connected by, for example, laser welding to the wire connection 73 of the first terminal electrode 63 disposed on the first flange portion 34. Similarly, the other end portion of the first wire 61 is connected to the second terminal electrode 64 disposed on the second flange portion 35. One end portion of the second wire 62 is connected to the third terminal electrode 65 disposed on the first flange portion 34, and the other end portion of the second wire 62 is connected to the fourth terminal electrode 66 disposed on the second flange portion 35.

The first and third terminal electrodes 63 and 65 are secured to the first flange portion 34 with the adhesives 67, and the second and fourth terminal electrodes 64 and 66 are secured to the second flange portion 35 with the adhesives 67, as described above. Regions to which the adhesives 67 are applied are clearly illustrated in FIG. 2. As seen from FIG. 2 and FIG. 1, in the terminal electrodes 63 to 66, the adhesives 67 do not reach the first bent portions 70 nor the mounting portions 71. Accordingly, the first bent portions 70 and the mounting portions 71 are not secured to the flange portions 34 and 35 with the adhesives 67. In particular, in the embodiment, regions of the terminal electrodes 63 and 65 that are not secured with the adhesives 67 extend to the side of the bases 69 beyond the first bent portions 70.

As illustrated in FIG. 5, mounting solder 76 is applied to connect the terminal electrodes 63 to 66 to conductive lands 75 serving as conductive portions of the mounting substrate 74. In the case where the adhesives 67 are applied in the above manner, the locations at which the terminal electrodes 63 to 66 are secured to the flange portions 34 and 35 with the adhesives 67 can be kept separate from the locations at which the mounting solder 76 is applied.

Figure 6A:
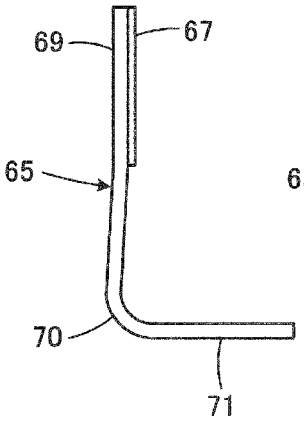
FIG. 6A is a diagram illustrating the deformation of the terminal electrode due to the expansion or contraction of the mounting substrate in the state illustrated in FIG. 5, in which the coil component is mounted.
Figure 6B:
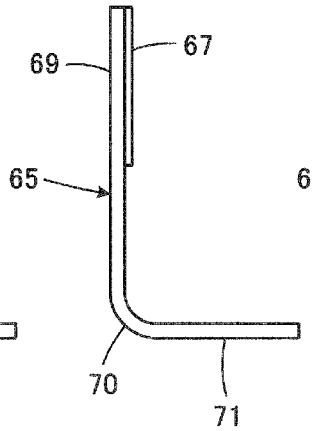
FIG. 6B is a diagram illustrating the deformation of the terminal electrode due to the expansion or contraction of the mounting substrate in the state illustrated in FIG. 5, in which the coil component is mounted.
Figure 6C:
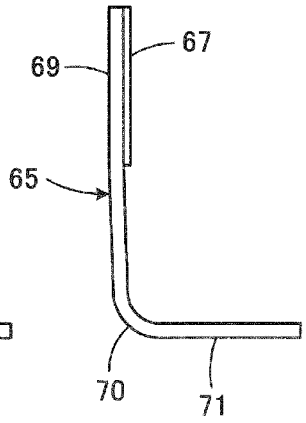
FIG. 6C is a diagram illustrating the deformation of the terminal electrode due to the expansion or contraction of the mounting substrate in the state illustrated in FIG. 5, in which the coil component is mounted.

Accordingly, when the mounting substrate 74 illustrated in FIG. 5 expands or contracts, as schematically illustrated in FIG. 6A, FIG. 6B, and FIG. 6C, each of the terminal electrodes 63 to 66 can deform at a portion extending from the base 69 to the mounting portion 71 with respect to the flange portions 34 and 35 of the drum-shaped core 33, which is a rigid body. FIG. 6B illustrates the third terminal electrode 65 at a normal temperature, FIG. 6A illustrates the third terminal electrode 65 at a high temperature, and FIG. 6C illustrates the third terminal electrode 65 at a low temperature. The deformation reduces stress applied to the mounting solder 76 due to the expansion or contraction of the mounting substrate 74 caused by the heat cycle. Accordingly, a crack can be inhibited from forming in the mounting solder 76 and inhibited from expanding.

Figure 4:
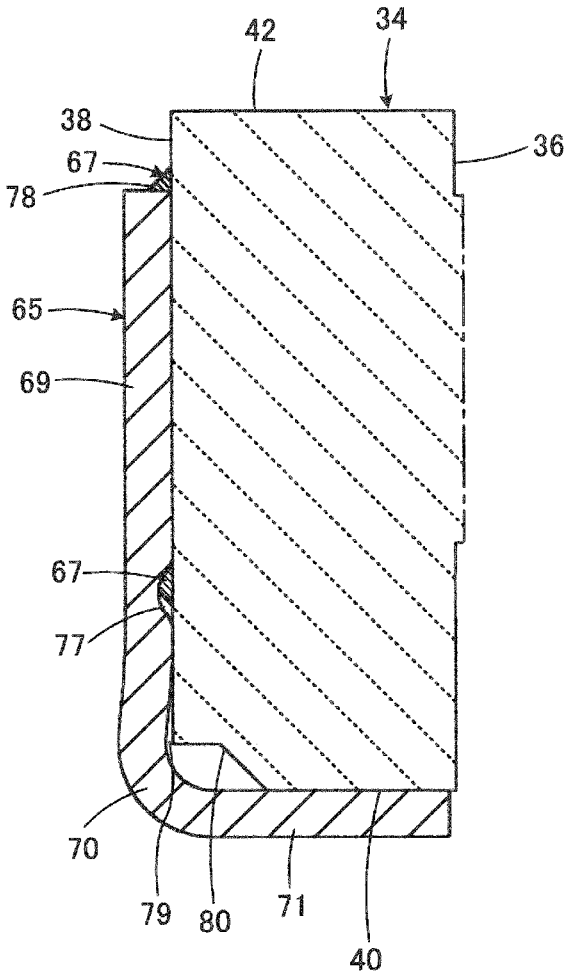
FIG. 4 is a sectional view of a flange portion and terminal electrode of the drum-shaped core that the coil component illustrated in FIG. 1 includes taken along line IV-IV in FIG. 1.

As clearly illustrated in FIG. 3 and FIG. 4, a groove 77 is formed on a surface of the third terminal electrode 65 that faces the outer surface 38 of the first flange portion 34 in order to apply the adhesive 67 in the above manner with certainty. The groove 77 is formed by press working. In the case where the groove 77 is formed, the adhesive 67 is often present in at least part of the groove 77. Similarly, the grooves 77 are formed on the other terminal electrodes 63, 64, and 66. In the case where the grooves 77 are thus formed on the terminal electrodes 63 to 66, the adhesives 67 enter the grooves 77 when spreading out, and the edges of the regions to which the adhesives 67 are applied are defined by the grooves 77. This reduces the chance of the adhesives 67 inadvertently spreading out to an undesirable area.

The above description is based on an idea that there are no adhesives 67 in the regions that are not adhered with the adhesives 67. However, the adhesives 67 may flow into the regions that are not adhered with the adhesives 67. In this case, the amount of the adhesives 67 is negligible in the regions into which the adhesives 67 flow. Accordingly, the adhesives 67 adhere to either the terminal electrodes 63 to 66 or the flange portions 34 and 35, and the terminal electrodes 63 to 66 do not adhere to the flange portions 34 and 35.

As clearly illustrated in FIG. 1, at the edge of the base 69 of each of the terminal electrodes 63 to 66, the adhesives 67 form fillets 78 extending in the thickness direction of the terminal electrodes 63 to 66. With this structure, the fillets 78 increase the area of contact between the terminal electrodes 63 to 66 and the adhesives 67 and the area of contact between the flange portions 34 and 35 and the adhesives 67. Accordingly, the formation of the fillets 78 increases adhesive strength and ensures sufficient adhesive strength between the terminal electrodes 63 to 66 and the flange portions 34 and 35, even when there are no adhesives 67 on at least the first bent portion 70 and mounting portion 71 of each of the terminal electrodes 63 to 66. In addition, the fillets 78 suppress misalignment of the base 69 of each of the terminal electrodes 63 to 66 in the direction in which the outer surfaces 38 and 39 of the flange portions 34 and 35 extend. In addition, the fillets 78 decrease variations in the positions at which the terminal electrodes 63 to 66 are joined in this direction and increase the adhesive strength.

The fillets 78 are typically formed, although this depends on the wettability and liquidity of the adhesives 67 with respect to the terminal electrodes 63 to 66, in a manner in which the adhesives 67 are applied thickly to predetermined regions of the outer surfaces 38 and 39 of the flange portions 34 and 35, and the terminal electrodes 63 to 66 are pressed against the adhesives 67 such that the adhesives 67 protrude from the circumferences of the terminal electrodes 63 to 66.

FIG. 4 is a sectional view of the first flange portion 34 and third terminal electrode 65 of the drum-shaped core 33 that the coil component 31 illustrated in FIG. 1 includes. As clearly illustrated in FIG. 4, there is a space 79 between the vicinity of the ridge line of the first flange portion 34 along which the outer surface 38 and bottom surface 40 of the first flange portion 34 meet and the vicinity of the first bent portion 70 of the third terminal electrode 65. The space 79 is conducive to an increase in the degree of freedom of the deformation of the third terminal electrode 65, more specifically, the degree of freedom of the displacement of the mounting portion 71 of the third terminal electrode 65 with respect to the first flange portion 34.

Although the space 79 formed between the first flange portion 34 and the third terminal electrode 65 is described with reference to FIG. 4, spaces are also formed between the first flange portion 34 and the first terminal electrode 63 and between the second flange portion 35 and the second and fourth terminal electrodes 64 and 66.

A recessed portion 80 is formed along the ridge line along which the outer surface 38 and bottom surface 40 of the first flange portion 34 meet. Similarly, a recessed portion 81 is formed along the ridge line along which the outer surface 39 and bottom surface 41 of the second flange portion 35 meet (see FIG. 5). The recessed portions 80 and 81 are conducive to an increase in the degree of freedom of the deformation of the terminal electrodes 63 to 66.

Figure 7:
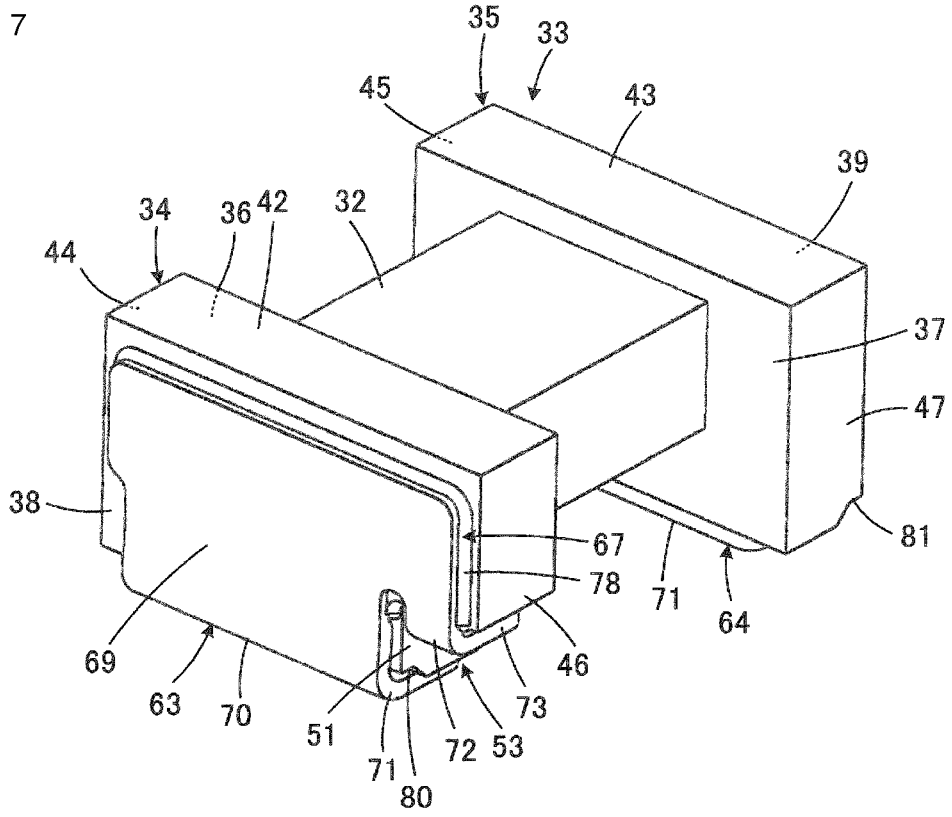
FIG. 7 is a perspective top view of the drum-shaped core and terminal electrodes that a coil component according to a second embodiment of the present disclosure includes.
Figure 8:
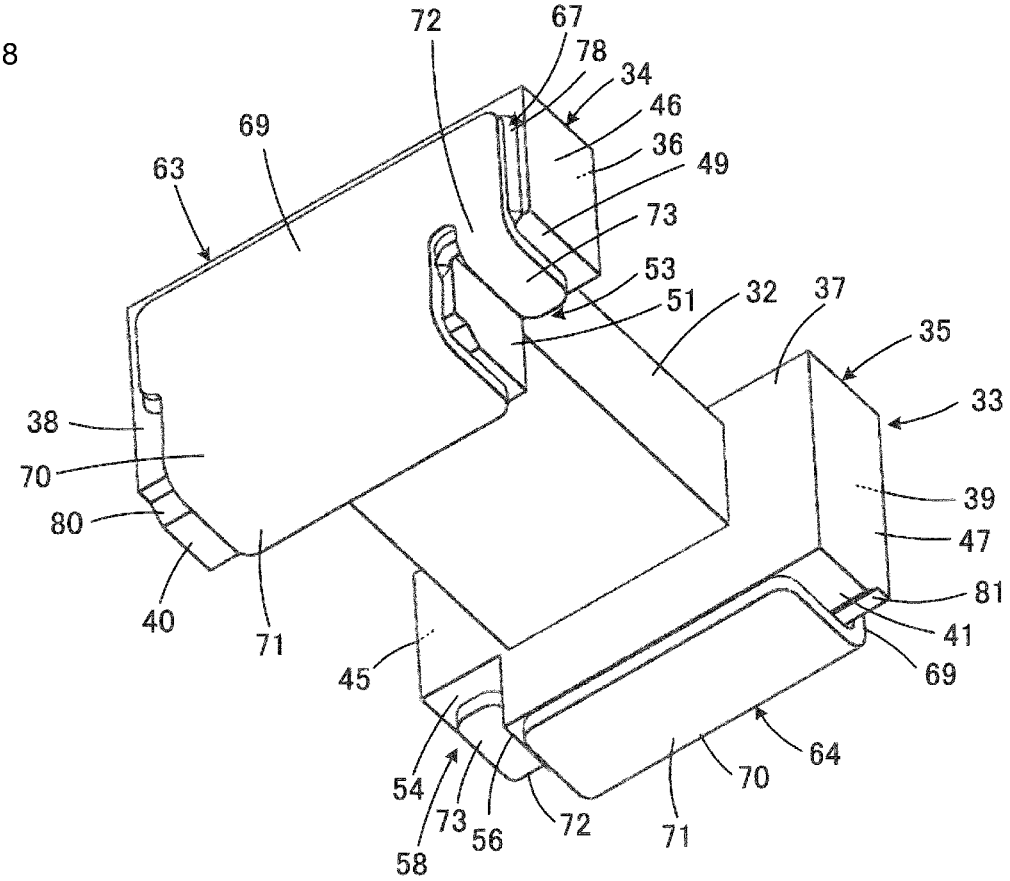
FIG. 8 is a perspective bottom view of the drum-shaped core and the terminal electrodes illustrated in FIG. 7.
Figure 9:
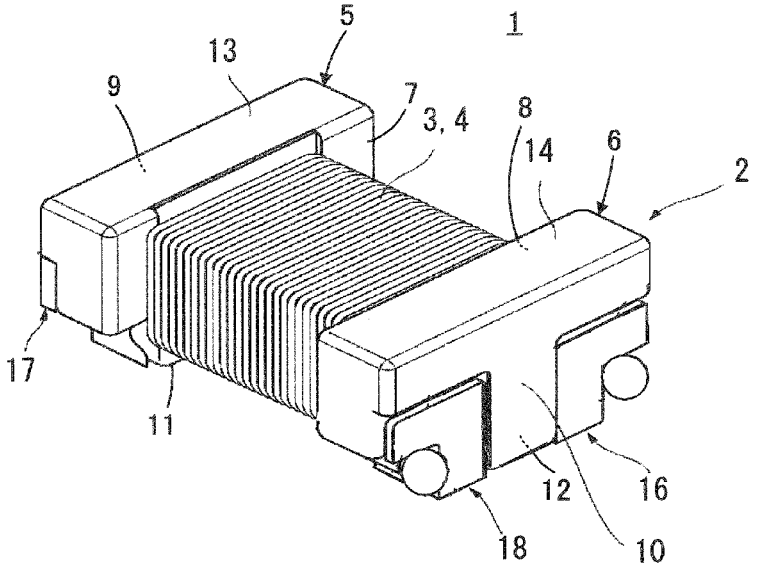
FIG. 9 is a perspective view of the appearance of a coil component disclosed in Japanese Unexamined Patent Application Publication No. 2015-35473.
Figure 10:
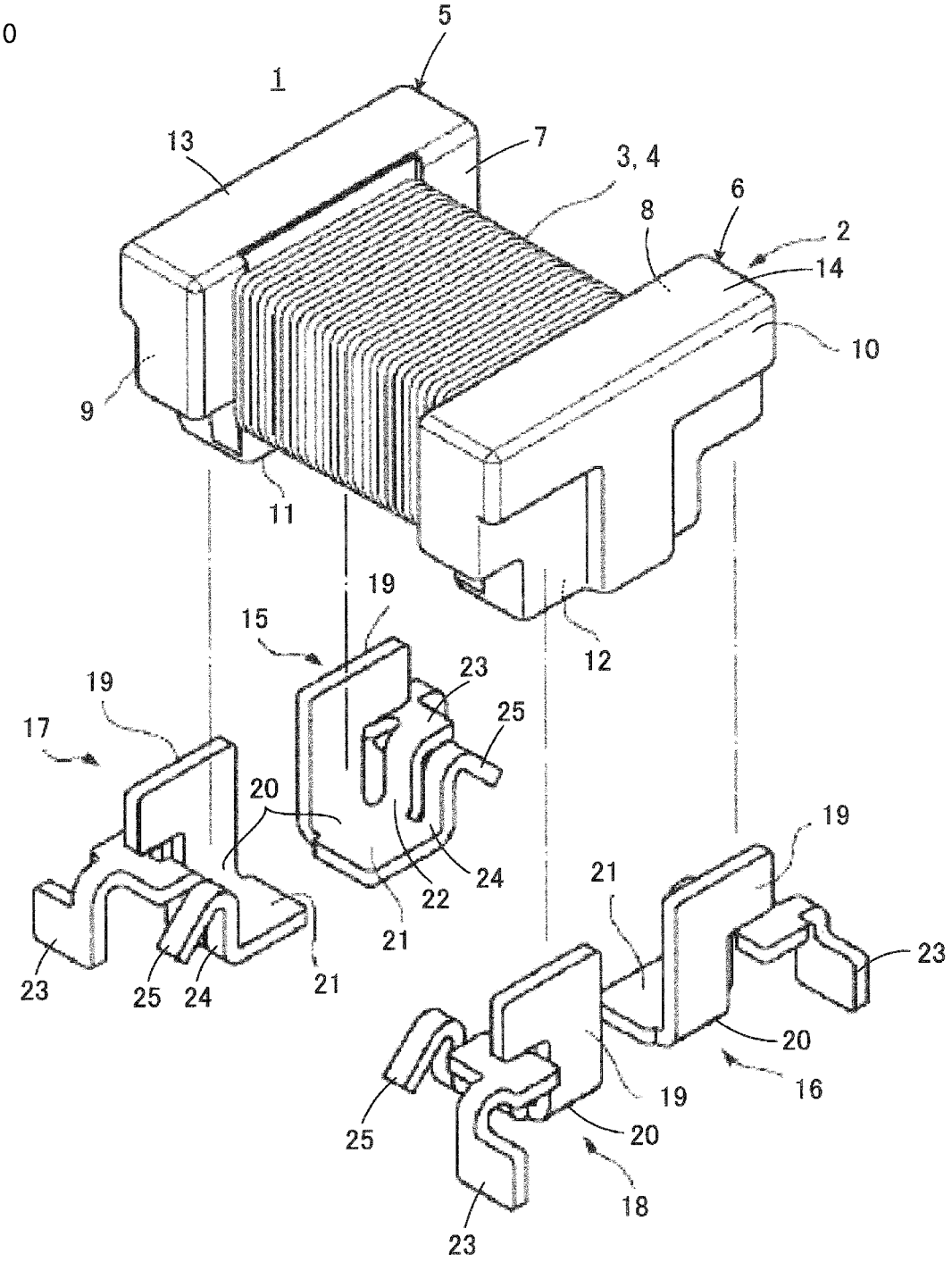
FIG. 10 is an exploded perspective view of part of the coil component illustrated in FIG. 9.

A coil component according to a second embodiment of the present disclosure will now be described with reference to FIG. 7 and FIG. 8. In FIG. 7 and FIG. 8, illustration of a wire is omitted, and only the drum-shaped core 33 and the terminal electrodes 63 and 64 that the coil component includes are illustrated. In FIG. 7 and FIG. 8, components corresponding to the components illustrated in FIG. 1 to FIG. 6C are represented by like reference numbers, and a duplicated description is omitted.

The second embodiment is characterized in that the coil component forms a single coil including two terminal electrodes 63 and 64 that are respectively disposed on the first and second flange portions 34 and 35 and a wire, not illustrated.

More specifically, the recess 53 in a notch shape is formed at the end portion of the second side surface 46 of the first flange portion 34 on the side of the bottom surface 40, and the recess 53 is defined by the lateral surface 49 extending parallel to the bottom surface 40 and the longitudinal surface 51 extending parallel to the second side surface 46.

Similarly, the recess 58 in a notch shape is formed at the end portion of the first side surface 45 of the second flange portion 35 on the side of the bottom surface 41, and the recess 58 is defined by the lateral surface 54 extending parallel to the bottom surface 41 and the longitudinal surface 56 extending parallel to the first side surface 45.

The coil component according to the second embodiment also includes the first and second terminal electrodes 63 and 64. The first terminal electrode 63 is secured to the first flange portion 34 with the adhesive 67. The second terminal electrode 64 is secured to the second flange portion 35 with the adhesive 67.

The first terminal electrode 63 includes the base 69 extending along the outer surface 38 of the first flange portion 34 and the mounting portion 71 extending along the bottom surface 40 of the first flange portion 34 from the first bent portion 70 extending from the base 69 and covering the ridge line along which the outer surface 38 and bottom surface 40 of the first flange portion 34 meet. The first terminal electrode 63 also includes the wire connection 73 extending from the second bent portion 72 extending from the base 69. The wire connection 73 is disposed in the recess 53 formed on the first flange portion 34.

The first terminal electrode 63 and the second terminal electrode 64 have the same shape. Accordingly, the reference numbers 69, 70, 71, 72, and 73, which are respectively used to represent the base, first bent portion, mounting portion, second bent portion, and wire connection of the first terminal electrode 63, are also used to represent the base, first bent portion, mounting portion, second bent portion, and wire connection of the second terminal electrode 64.

The second terminal electrode 64 includes the base 69 extending along the outer surface 39 of the second flange portion 35 and the mounting portion 71 extending along the bottom surface 41 of the second flange portion 35 from the first bent portion 70 extending from the base 69 and covering the ridge line along which the outer surface 39 and bottom surface 41 of the second flange portion 35 meet. The second terminal electrode 64 also includes the wire connection 73 extending from the second bent portion 72 extending from the base 69. The wire connection 73 is disposed in the recess 58 formed on the second flange portion 35.

One end portion of the wire, not illustrated, is connected by, for example, laser welding to the wire connection 73 of the first terminal electrode 63 disposed on the first flange portion 34. Similarly, the other end portion of the wire is connected to the wire connection 73 of the second terminal electrode 64 disposed on the second flange portion 35.

The first and second terminal electrodes 63 and 64 are respectively secured to the first and second flange portions 34 and 35 with the adhesives 67, as described above. The first bent portion 70 and mounting portion 71 of each of the terminal electrodes 63 and 64 are not secured to the flange portions 34 and 35 with the adhesives 67. In the second embodiment, a lower portion of the base 69 is secured with the adhesive 67. Alternatively, in the second embodiment, the region that is not secured with the adhesive 67 may extend to the side of the base 69 beyond the first bent portion 70 as in the case of the first embodiment.

In the case where the adhesives are applied in the above manner, when the mounting substrate expands or contracts, each of the terminal electrodes 63 and 64 can deform at a portion extending from the base 69 to the mounting portion 71 with respect to the flange portions 34 and 35 of the drum-shaped core 33, which is a rigid body, as in the case of the first embodiment. Accordingly, a good resistance to the heat cycle can be achieved.

In the second embodiment, as in the case of the first embodiment, the adhesives 67 form the fillets 78. There are spaces between the vicinity of the ridge line of the flange portion 34 along which the outer surface 38 and bottom surface 40 of the flange portion 34 meet and in the vicinity of the first bent portion 70 of the terminal electrode 63 and between the vicinity of the ridge line of the flange portion 35 along which the outer surface 39 and bottom surface 41 of the flange portion 35 meet and in the vicinity of the first bent portion 70 of the terminal electrode 64. The recessed portion 80 is formed along the ridge line along which the outer surface 38 and bottom surface 40 of the flange portion 34 meet. The recessed portion 81 is formed along the ridge line along which the outer surface 39 and bottom surface 41 of the flange portion 35 meet. Although the figures do not clearly illustrate, grooves that define the edges of regions to which the adhesives 67 are applied are formed on the terminal electrodes 63 and 64.

In the above embodiments, not only the mounting portions 71, but also the first bent portions 70 are not secured to the flange portions 34 and 35. However, the first bent portions 70 may be secured to the flange portions 34 and 35 because the terminal electrodes 63 to 66 can deform provided that the mounting portions 71 are not secured to the flange portions 34 and 35.

A plate core may be disposed so as to extend between the first and second flange portions 34 and 35 with one main surface thereof in contact with the upper surfaces 42 and 43 of the first and second flange portions 34 and 35. In this case, the drum-shaped core 33 and the plate core form a closed magnetic circuit in a manner in which the drum-shaped core 33 and the plate core are each composed of a magnetic material such as ferrite.

Although the coil component according to the present disclosure is described based on the specific embodiments, the embodiments are described by way of example, and the features can be partially replaced or combined between the embodiments.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a drum-shaped core including a winding core portion and a pair of flange portions disposed at respective end portions of the winding core portion, each of the flange portions having an inner surface that faces a winding core portion and is in contact with the corresponding end portion of the winding core portion, an outer surface that faces oppositely and is opposite to the inner surface, a bottom surface that connects the inner surface and the outer surface to each other and faces a mounting substrate during mounting, an upper surface that is opposite to the bottom surface, and a pair of side surfaces that are opposite to each other and extend in a direction so as to connect the bottom surface and the upper surface to each other;

a wire wound around the winding core portion; and a terminal electrode electrically connected to an end portion of the wire and secured to one of the flange portions with an adhesive, wherein the terminal electrode includes a base disposed on the outer surface of the flange portion, a wire connection extending from a first portion of the base, and a mounting portion extending from a second portion of the base, for an electrical connection with a conductive portion of the mounting substrate, that is disposed to cover a portion of a bottom surface of the flange portion and extends from a bent portion extending from the base and covering a ridge line along which the outer surface and the bottom surface meet, wherein the wire is connected to the wire connection, wherein the mounting portion is not secured to the flange portion to permit freedom of deformation between the mounting portion and the flange portion, and wherein a difference in height in the thickness direction between the wire connection and the mounting portion is greater than a width of the wire.

2. The coil component according to claim 1, wherein the bent portion is not secured to the flange portion.

3. The coil component according to claim 2, wherein a region of the terminal electrode that is not secured to the flange portion extends to a base side beyond the bent portion.

4. The coil component according to claim 1, wherein there is a space between a vicinity of the ridge line of the flange portion and a vicinity of the bent portion of the terminal electrode.

5. A coil component comprising:

a drum-shaped core including a winding core portion and a pair of flange portions disposed at respective end portions of the winding core portion, each of the flange portions having an inner surface that faces a winding core portion and is in contact with the corresponding end portion of the winding core portion, an outer surface that faces oppositely and is opposite to the inner surface, a bottom surface that connects the inner surface and the outer surface to each other and faces a mounting substrate during mounting, an upper surface that is opposite to the bottom surface, and a pair of side surfaces that are opposite to each other and extend in a direction so as to connect the bottom surface and the upper surface to each other;

a wire wound around the winding core portion; and a terminal electrode electrically connected to an end portion of the wire and secured to one of the flange portions with an adhesive, wherein the terminal electrode includes a base disposed on the outer surface of the flange portion, and a mounting portion, for an electrical connection with a conductive portion of the mounting substrate, that is disposed to cover a portion of a bottom surface of the flange portion and extends from a bent portion extending from the base and covering a ridge line along which the outer surface and the bottom surface meet, wherein the mounting portion is not secured to the flange portion, wherein a groove is formed on a surface of the terminal electrode that faces the outer surface of the flange portion, and the adhesive is present in at least part of the groove, wherein the groove is a concave portion of the terminal electrode, and wherein a first thickness of a first portion of the terminal electrode into which the groove is formed is thinner than a second thickness of a second portion of the terminal electrode without the groove formed therein.

6. A coil component comprising:

a drum-shaped core including a winding core portion and a pair of flange portions disposed at respective end portions of the winding core portion, each of the flange portions having an inner surface that faces a winding core portion and is in contact with the corresponding end portion of the winding core portion, an outer surface that faces oppositely and is opposite to the inner surface, a bottom surface that connects the inner surface and the outer surface to each other and faces a mounting substrate during mounting, an upper surface that is opposite to the bottom surface, and a pair of side surfaces that are opposite to each other and extend in a direction so as to connect the bottom surface and the upper surface to each other;

a wire wound around the winding core portion; and a terminal electrode electrically connected to an end portion of the wire and secured to one of the flange portions with an adhesive, wherein the terminal electrode includes a base disposed on the outer surface of the flange portion, a wire connection extending from a first portion of the base, and a mounting portion extending from a second portion of the base, for an electrical connection with a conductive portion of the mounting substrate, that is disposed to cover a portion of a bottom surface of the flange portion and extends from a bent portion extending from the base and covering a ridge line along which the outer surface and the bottom surface meet, wherein the wire is connected to the wire connection, wherein the mounting portion is not secured to the flange portion to permit freedom of deformation between the mounting portion and the flange portion, and wherein the adhesive forms a fillet extending in a thickness direction of the terminal electrode on at least part of an edge of the base of the terminal electrode.

* * * * *